United States Patent [19]

Walker

[11] Patent Number: 4,894,898

[45] Date of Patent: Jan. 23, 1990

[54] METHOD OF MAKING CASTELLATED BEAMS

[75] Inventor: Peter A. Walker, Halifax, England

[73] Assignee: Wescol Structures Limited, Halifax, United Kingdom

[21] Appl. No.: 295,444

[22] Filed: Jan. 10, 1989

[30] Foreign Application Priority Data

Jan. 12, 1988 [GB] United Kingdom ..... 8800610
Sep. 22, 1988 [GB] United Kingdom ..... 8822275

[51] Int. Cl.[4] ..... B23P 17/00

[52] U.S. Cl. ..... 29/155 R; 29/416; 29/425; 29/463; 52/729

[58] Field of Search ..... 29/155 R, 416, 425, 29/463, 557, 558; 52/696, 729; 83/DIG. 2

[56] References Cited

U.S. PATENT DOCUMENTS 1,644,940 10/1927 Moyer ..... 29/155 R
3,050,831 8/1962 Diamond ..... 29/155 R
3,283,464 11/1966 Litzka ..... 52/729 X
3,874,051 4/1975 Malik ..... 29/155 R

FOREIGN PATENT DOCUMENTS 164740 4/1953 Australia ..... 29/155 R

*Primary Examiner*—Joseph M. Gorski
*Assistant Examiner*—Andrew E. Rawlins
*Attorney, Agent, or Firm*—Reising, Ethington, Barnard, Perry & Milton

[57] ABSTRACT

A method of producing castellated beam. A first continuous cut 18 is made along the web of a universal beam, and a second cut 20 is then made along the web on a path differing from the path of the first cut. The cuts are such as to define rectilinear sections (24, 26) lying on alternate sides of the centerline of the web and at least partly curvilinear sections (25, 27) joining the closest ends of adjacent rectilinear sections. The cut halves of the beam are separated and are then welded together (at 28) in regions formed by juxtaposition of rectilinear sections of the two halves. Beams, having circular, elliptical or other curvilinear openings can thus be made.

13 Claims, 5 Drawing Sheets

METHOD OF MAKING CASTELLATED BEAMS

This invention relates to improvements in castellated beams.

Castellated beams are beams used in the construction of buildings and the like, of the general type having a web between two flanges, in which the web is not continuous but has normally hexagonal apertures therein. Castellated beams are traditionally made from a standard universal beam having a web depth that is two thirds the desired web depth of the final castellated beam. The web is then cut, for example using an oxy-acetylene burner, in a continuous line defining a series of equal lines lying to alternate sides of, equally spaced from and parallel to the centreline of the web, each adjacent pair of equal lines having their closest ends joined by a further line that is twice the length of an equal line and that crosses and is inclined to the centreline of the web, alternate further lines being at equal and opposite angles to the centreline of the web. The two halves of the beam are then separated and moved relative to one another by a distance sufficient to juxtapose the equal lines, and thereafter the adjacent equal line portions of the web are welded back together again. This produces a beam of one and a half times the depth of the original universal beam, but having the same weight owing to the fact that there are now a series of hexagonal holes in the web.

Known castellated beams have only been made with hexagonal or square castellations. Square shapes are avoided since their structural performance is less good than the hexagonal castellations. Even the traditional castellated beams with hexagonal castellation have a structural limit which is lower than it might be owing to the presence of the corners of the hexagonal shapes adjacent the upper and lower flanges.

The invention seeks to provide a method of producing castellated beams having shapes other than the traditional hexagonal shapes, and capable of similar mechanical properties for less weight of material in the finished beam.

According to the present invention there is provided a method of producing a castellated beam which comprises the steps of taking a universal beam, making a first continuous cut along the web thereof, making a second cut along the web on a path differing from the path of the first cut, the cuts being such as to define rectilinear sections lying on alternate sides of the centreline of the web and at least partly curvilinear sections joining the closest ends of adjacent rectilinear sections, separating the cut halves of the beam, and welding the cut halves together in regions formed by juxtaposition of rectilinear sections of the two halves.

The cutting is preferably accomplished using oxy-acetylene burners as with traditional production of castellated beams. The use of the double cutting approach of the invention allows shapes to be produced which were hitherto impossible. In particular, castellated beams can be produced with circular or oval shaped holes. This is important for aesthic reasons since in many buildings such beams are not covered by false ceilings but are left on view.

It should be pointed out that circular holes could be produced in a universal beam merely by cutting the same out of the beam web. However, the beam depth in this case would be no greater than that of the original universal beam and the beam would be weakened by the material lost. The method of the invention allows such holes to be produced from a universal beam leading to a castellated beam of greater depth than the original universal beam, and so stronger than the original beam.

The second cut may be continuous or discontinous.

When the second cut is continous then desirably the first cut comprises a plurality of rectilinear sections of substantially equal length lying to one side of the centreline of the web and a plurality of similar curvilinear sections each joining the closest ends of adjacent rectilinear sections and twice crossing the centreline of the web, the centres of all the rectilinear sections being substantially equally spaced along the length of the universal beam by a given distance, and the second cut is a mirror image of the first cut with respect to the centreline of the beam but displaced longitudinally from the first cut by a distance equal to half the given distance. The curvilinear section may then preferably be either a semicircle or a semi-ellipse.

When the cut is discontinuous then conveniently the first cut comprises a plurality of rectilinear sections of substantially equal length lying to alternate sides of the centreline of the web and a plurality of curvilinear sections each joining the closest ends of adjacent rectilinear sections and crossing the centreline of the web, the centres of all the rectilinear sections being substantially equally spaced along the length of the universal beam by a given distance, and the second cut is a discontinuous series of curvilinear sections each joining the closest ends of adjacent rectilinear sections and crossing the centreline of the web.

Desirably, for any given adjacent pair of rectilinear sections the curvilinear section of the first cut and the curvilinear section of the second cut joining the closest ends of those rectilinear sections are mirror images one of the other about a straight line joining the closest ends of the rectilinear sections. Each curvilinear section may preferably be an arc of a circle or of an ellipse.

The invention will be described further, by way of example, with reference to the accompanying drawings, in which:

FIGS. 2A and 2B to 5A and 5B are views similar to FIGS. 1A and 1B of other embodiments of beam formed in accordance with the invention.

Figure 1A:
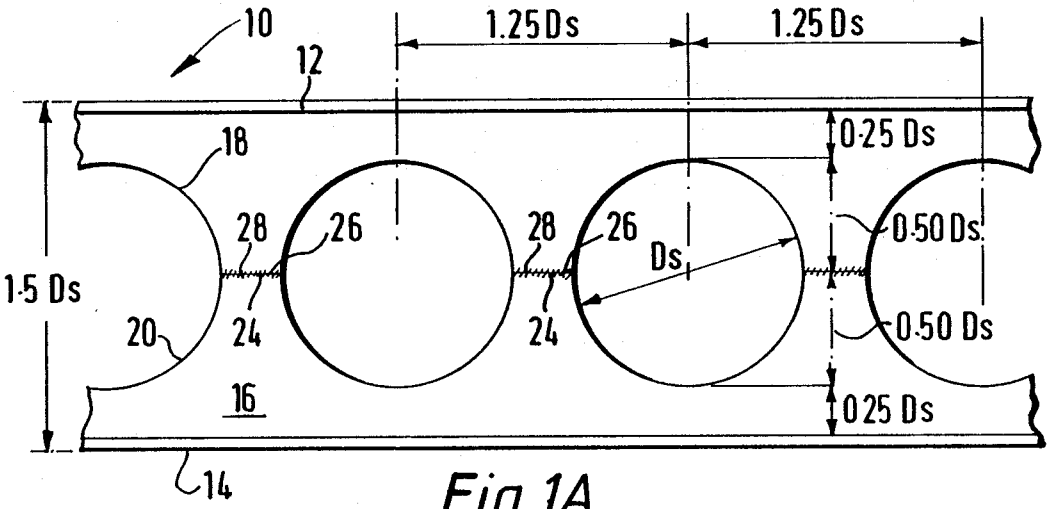
FIG. 1A is a diagrammatic elevational view of a first embodiment of beam formed in accordance with the invention.
Figure 1B:
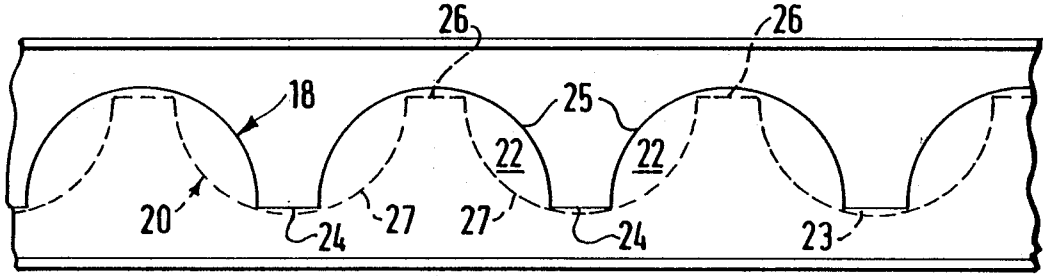
FIG. 1B is a diagrammatic representation of the double cutting pattern employed to obtain the beam of FIG. 1.

Referring to FIG. 1A of the drawings, a castellated beam 10 in accordance with the invention has flanges 12 and 14 between which extends a web 16. The beam 10 is produced from a universal beam (FIG. 1B) having a depth DS that is two thirds of the depth of the beam 10 shown in FIG. 1. The web 16 of the universal beam is cut along two continuous cutting lines 18, 20, and the material 22, 23 between the cutting lines 18, 20 is removed. From FIG. 1B it will be seen that the first cut 18 (shown in solid line) comprises a plurality of rectilinear sections 24 with substantially equal length, all lying to one side of the centre line of the web, and a plurality of similar semicircular sections 25 each joining the closest ends of two adjacent rectilinear sections 24. The centres of all the rectilinear sections 24 are substantially equally spaced along the length of the beam. The second cut 20 (shown in broken line) is a mirror image of the first cut 18 with respect to the centre line of the beam, but is displaced longitudinally from the first cut by a distance equal to half the distance between centres of adjacent rectilinear sections. The second cut thus defines rectilinear sections 26 joined by semicircular sections 27.

After the two cuts have been formed the two halves of the beam are separated and one is moved longitudinally relative to the other in order to juxtapose the rectilinear sections 24, 26. These sections are then welded together at 28 to produce the beam 10 illustrated in FIG. 1A.

In the embodiment illustrated, the finished beam 10 is 1.5 times the depth DS of the original universal beam. The centres of the circular cut out portions are 1.25 DS apart and the gap between the circular cut out portions 28 and each respective flange 12, 14 is 0.25 DS. The diameter of each cut out portion is DS. It will be seen that the minimum web thickness, at the point where the cut out is most closely adjacent to its respective flange 12, 14, is 0.25 DS. This is the same residual web thickness as with a standard hexagonal castellated beam. However, owing to the circular shapes of the cut outs, the thickness increases from both sides of the minimum thickness point whereas with the standard castellated beam the minimum thickness persists for the length equal to one side of the hexagonal cut out. Tests have shown that the structural performance of a beam as shown in FIG. 1A is similar to that of a standard hexagonal castellated beam formed from an identical universal beam. It will be particularly noted that the circular castellated beam of the invention will be lighter in weight than the conventional hexagonal castellated beam, due to the removal of the material 22, 23.

The dimensions illustrated above have been chosen since they are similar to those most commonly employed with hexagonal castellated beams. However, it will be appreciated that other dimensions could equally well be chosen.

Figure 2A:
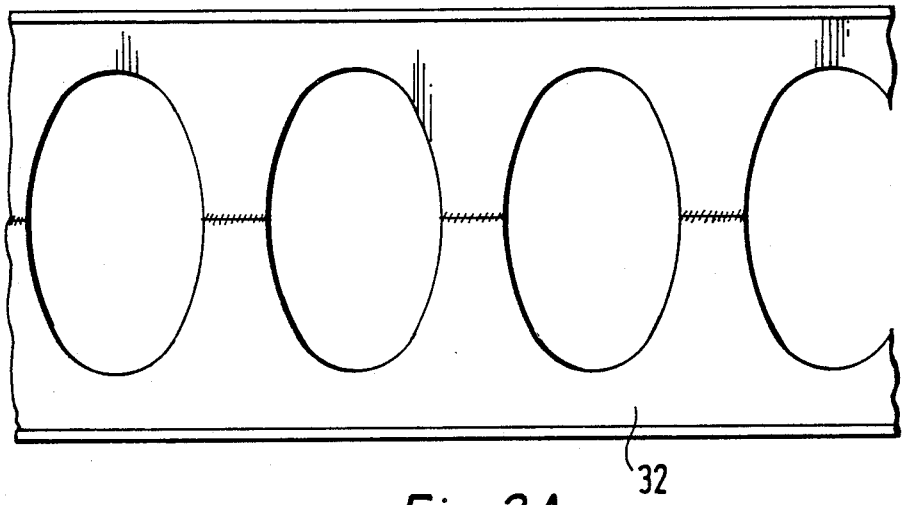
Figure 2B:
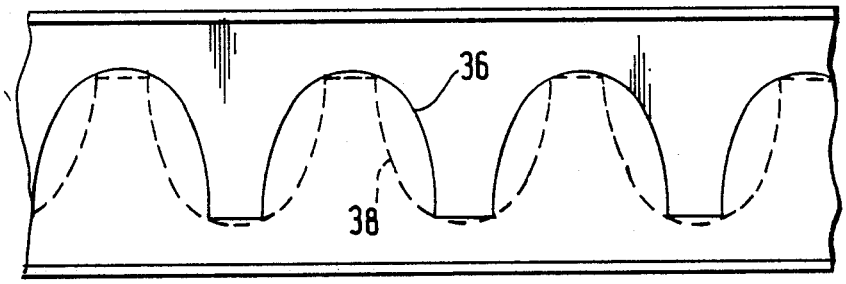
Figure 3A:
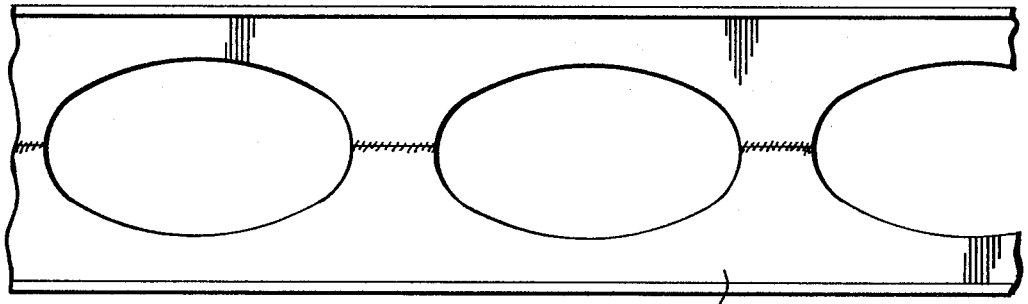
Figure 3B:
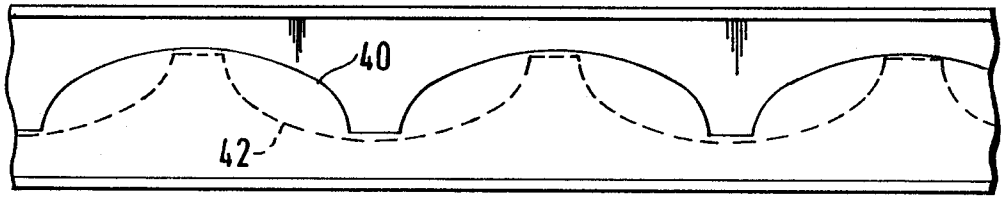

Other shapes, e.g. ellipses, ovals, and the like may be made by suitable modifications to the cutting lines 18 and 20. FIGS. 2A and 3A shown examples of such beams 32 and 34 respectively. FIG. 2B shows the cutting lines 36 (shown solid) and 38 (shown broken) needed for that formation of the beam of FIG. 2A, and FIG. 3B shows the cutting lines 40 (shown solid) and 42 (shown broken) needed for the formation of the beam of FIG. 3A.

Figure 4A:
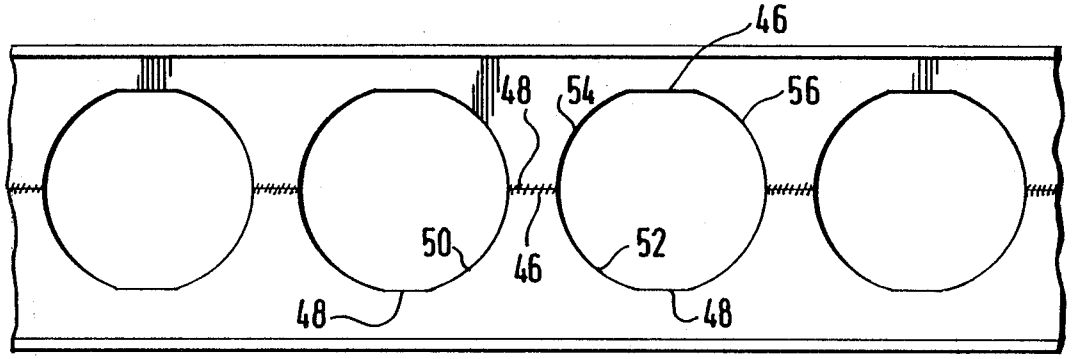
Figure 4B:
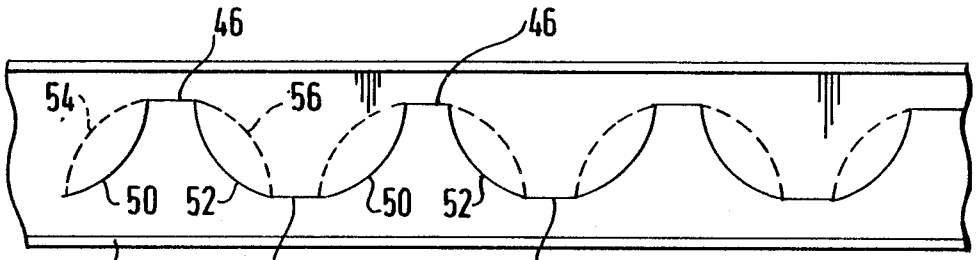

It is also possible to produce 'hybrid' shapes, e.g. where the two cutting lines coincide for parts of their paths. In such cases the first cutting line can be regarded as a continuous line and the second cutting line as a discontinuous line. One example is shown in FIGS. 4A and 4B. Thus, with reference to FIG. 4B the first cut 44 (shown solid) comprises a plurality of rectilinear sections 46, 48 of substantially equal length lying to alternate sides of the centre line of the web, and a plurality of curvilinear sections 50, 52 each joining the closest ends of two adjacent rectilinear sections. The centres of all the rectilinear sections are again substantially equally spaced along the length of the beam. The second cut is a discontinuous series of curvilinear sections 54, 56, each joining the closest ends of two adjacent rectilinear sections and crossing the centre line of the web. Each of the sections 50, 52, 54, 56 is an arc of a circle and the arcs that extend between any given adjacent pair of rectilinear sections are mirror images one of the other about a straight line joining the ends of those rectilinear sections. Thus, arcs 50 and 54 are mirror images, and arcs 52, 56 are mirror images.

After forming the cuts the two beam halves are separated and moved longitudinally one relative to the other until the rectilinear sections of the two halves are juxtaposed. The beams are then welded together in the regions at juxtaposition, as before. In this case the openings are in the form of circles having flatenned top and bottom regions as shown in FIG. 4A.

Figure 5A:
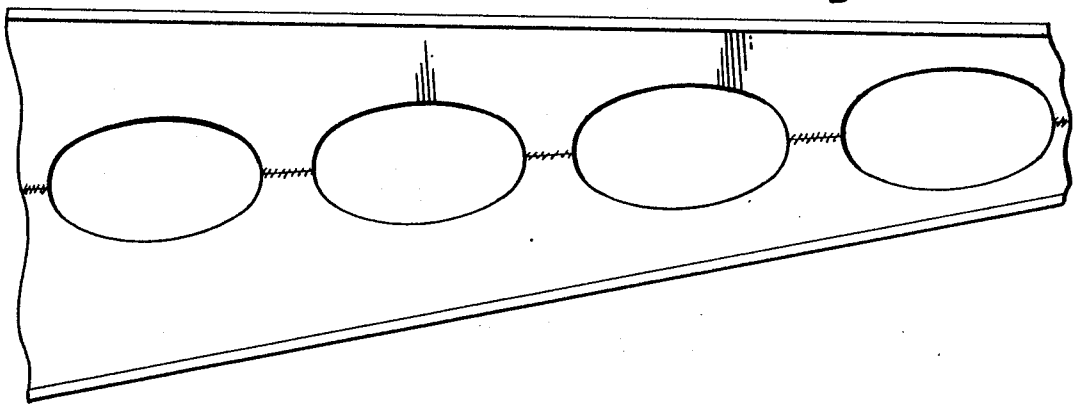
Figure 5B:
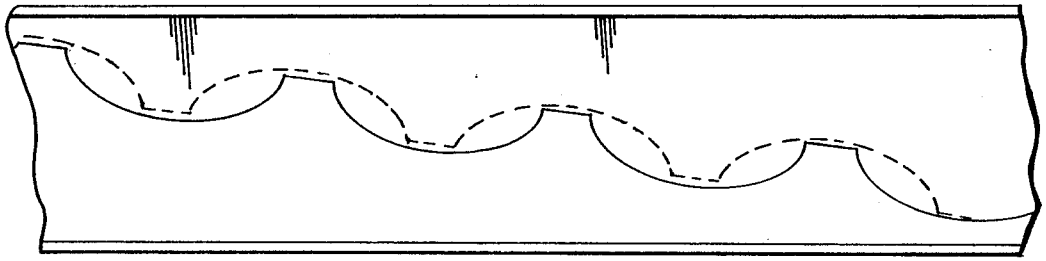

FIGS. 5A and 5B show an embodiment of tapered castellated beam according to the invention, effected by making the cuts long paths that are symmetrical with respect to a line inclined to the centreline of the web of the universal beam. After the cuts have been completed one half of the cut beam is turned end for end with respect to the other half, and is also moved longitudinally relative to the other half in order to juxtapose the rectilinear sections. These are then welded together to produce the tapered beam shown in FIG. 5A.

It will appreciated that other asymmetrical forms of beam may be manufactured, for example beams with openings that are symmetrical along a line that extends parallel to, but offset from, the centreline of the finished castellated beam. Similarly, it will be appreciated that the openings themselves need not be symmetrical and that large varieties of shaped can be produced by appropriate choice of cutting lines.

The invention thus provides a simple method of producing castellated beams having shapes other than the standard hexagonal shape currently employed.

I claim:

1. A method of producing a castellated beam, comprising the steps of providing a universal beam having a web which has a centreline extending along the length of the web, making a first continuous cut along the entire length of the web along a path, thereby forming a first partial web, making a second cut along the entire length of the web along a path differing from the path of the first cut, thereby forming a second partial web, each cut defining on each partial web rectilinear sections and at least partly curvilinear sections joining the closest ends of adjacent rectilinear sections, with each rectilinear section of the first cut lying on a side of the centreline that is opposite to the side of the centreline upon which each rectilinear section of the second cut lies, the at least partly curvilinear sections of the first and second cuts bordering areas of the web located therebetween separating the partial halves of the beam, removing the bordered areas of the web, and abutting the rectilinear sections of the first partial web with the rectilinear sections of the second partial web, and then welding the rectilinear sections of the first partial web to the rectilinear sections of the second partial web.

2. A method according to claim 1 in which the second cut is continuous.

3. A method according to claim 2 in which the first cut comprises a plurality of rectilinear sections of substantially equal length lying on one side of the centreline of the web and a plurality of similar curvilinear sections each joining the closest ends of adjacent rectilinear sections and twice crossing the centreline of the web, the centres of all the rectilinear sections being equally spaced along the length of the universal beam by a given distance, and the second cut is a mirror image of the first cut with respect to the centreline of the beam but displaced longitudinally from the first cut by a distance equal to half the given distance.

4. A method according to claim 3 in which each curvilinear section is a semicircle.

5. A method according to claim 3 in which each curvilinear section is a semi-ellipse.

6. A method according to claim 1 in which the second cut is discontinuous.

7. A method according to claim 6 in which the first cut comprises a plurality of rectilinear sections of substantially equal length lying on one side of the centreline of the web and a plurality of curvilinear sections each joining the closest ends of adjacent rectilinear sections and crossing the centreline of the web, the centres of all the rectilinear sections being substantially equally spaced along the length of the universal beam by a given distance, and the second cut is a discontinuous series of curvilinear sections each joining the closest ends of adjacent rectilinear sections and crossing the centreline of the web.

8. A method according to claim 7 in which for any given adjacent pair of rectilinear sections the curvilinear section of the first cut and the curvilinear section of the second cut joining those rectilinear sections are mirror images one of the other about a straight line joining the ends of the rectilinear sections.

9. A method according to claim 7 or claim 8 in which each curvilinear section is an arc of a circle.

10. A method according to claim 7 of claim 8 in which each curvilinear section is an arc of an ellipse.

11. A method as set forth in either of claims 5 or 8 in which the rectilinear sections are all of substantially equal length, and the centres of all the rectilinear sections are substantially equally spaced along the length of the universal beam.

12. A method as set forth in either of claims 5 or 8 in which the rectilinear sections are all parallel to the centreline of the web.

13. A method as set forth in either of claims 5 or 8 in which the rectilinear sections are inclined at equal angles to the centreline of the web, and including turning one partial web end for end before abutting the rectilinear sections and welding the rectilinear sections of the first partial web to the rectilinear sections of the second partial web.

* * * * *